US006755950B2

(12) United States Patent
Castegnier

(10) Patent No.: US 6,755,950 B2
(45) Date of Patent: Jun. 29, 2004

(54) ELECTROCOAGULATION PRINTING METHOD PROVIDING AN IMAGE HAVING ENHANCED OPTICAL DENSITY

(75) Inventor: Adrien Castegnier, Outremont (CA)

(73) Assignee: Elcorsy Technology Inc., Saint-Laurent (CA)

( * ) Notice: Subject to any disclaimer, the term of this patent is extended or adjusted under 35 U.S.C. 154(b) by 182 days.

(21) Appl. No.: 10/119,887

(22) Filed: Apr. 11, 2002

(65) Prior Publication Data

US 2003/0194624 A1 Oct. 16, 2003

(51) Int. Cl.[7] ..... C25D 13/04

(52) U.S. Cl. ..... 204/486; 204/483; 204/508; 101/DIG. 29

(58) Field of Search ..... 204/486, 483, 204/508; 101/DIG. 29

(56) References Cited

U.S. PATENT DOCUMENTS 4,661,222 A 4/1987 Castegnier ..... 204/180.9
4,895,629 A 1/1990 Castegnier et al. ..... 204/180.9
5,538,601 A 7/1996 Castegnier ..... 204/486
5,750,593 A 5/1998 Castegnier et al. ..... 532/161
5,942,094 A * 8/1999 Castegnier et al. ..... 204/483
6,551,481 B2 * 4/2003 Castegnier et al. ..... 204/486

* cited by examiner

*Primary Examiner*—Kishor Mayekar
(74) *Attorney, Agent, or Firm*—Ogilvy Renault

(57) ABSTRACT

An improved electrocoagulation printing method is disclosed. A plurality of dots of colored, coagulated colloid representative of a desired image are formed on a moving, olefin-coated surface of a positive electrode, by electrocoagulation of a colloid present in an electrocoagulation printing ink filling an electrode gap defined between a positive electrode and a plurality of negative electrodes. The improvement comprises applying to selected negative electrodes a trigger signal of a voltage sufficient to energize same and cause point-by-point selective coagulation and adherence of the colloid onto the positive electrode surface opposite the surfaces of the energized electrodes. The trigger signal comprises at least two consecutive pulses having the aforesaid voltage and a predetermined pulse duration with a time interval therebetween at least as long as the pulse duration, thereby increasing the optical density of each dot and of the resulting image.

41 Claims, 2 Drawing Sheets

ELECTROCOAGULATION PRINTING METHOD PROVIDING AN IMAGE HAVING ENHANCED OPTICAL DENSITY

BACKGROUND OF THE INVENTION

The present invention pertains to improvements in the field of electrocoagulation printing. More particularly, the invention relates to an electrocoagulation printing method providing an image having enhanced optical density.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is thereafter cleaned by means of a plurality of rotating brushes and a cleaning liquid to remove any residual coagulated colloid adhered to the surface of the positive electrode.

When a polychromic image is desired, the negative and positive electrodes, the positive electrode coating device, ink injector, rubber squeegee and positive electrode cleaning device are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

Moreover, instead of providing a polychromic image in which the differently colored images are superimposed, it is possible to form on the olefin-coated positive electrode surface a plurality of colored pixels representative of a desired polychromic image, each pixel comprising juxtaposed dots of differently colored, coagulated colloid. To this end, a single positive electrode coating device as well as a single positive electrode cleaning device are utilized and the negative electrodes, ink injector and rubber squeegee are arranged to define a printing unit. The negative electrodes each have a cylindrical configuration with a predetermined cross-sectional dimension. Several printing units are disposed around the positive cylindrical electrode. The printing units each use a coloring of different color so as to form a plurality of dots of differently colored, coagulated colloid on the olefin-coated positive electrode surface, the distance between the negative electrodes of each printing unit being at least three times the cross-sectional dimension of each negative electrode to permit juxtaposition of the dots of differently colored, coagulated colloid, whereby to form the aforesaid pixels. These colored pixels are thereafter transferred from the positive electrode surface onto a substrate at a single transfer station so as to imprint the substrate with the polychromic image. Such an arrangement is described in Applicant's U.S. patent application Ser. No. 09/934,467, now U.S. Pat. No. 6,551,481 the teaching of which is incorporated herein by reference.

The optical density of each dot of colored, coagulated colloid can be varied by varying either the voltage applied to the negative electrodes to energize same or the period of time during which such a voltage is applied. Varying the voltage of selected ones of the negative electrodes causes corrosion of adjacent electrodes. Varying the period of time during which the voltage is applied to the negative electrodes, on the other hand, is limited by a threshold value at which there is an undesirable gas generation at the negative electrodes. For example, in the case of an electrocoagulation printing ink having an electrolytic conductivity of 100 mS at 30° C., this threshold value is 4 microseconds. Thus, if the period of time during which the voltage is applied to the negative electrodes is longer than 4 microseconds, there is an undesirable gas generation at the negative electrodes, which adversely affects the electrical signal and may lead to a complete blocking thereof.

SUMMARY OF THE INVENTION

It is therefore an object of the present invention to overcome the above drawbacks and to provide an electrocoagulation printing method enabling one to increase the optical density of the image printed by electrocoagulation.

According to one aspect of the invention, there is provided an electrocoagulation printing method comprising the steps of:

a) providing a positive electrolytically inert electrode having a continuous passivated surface moving at substantially constant speed along a predetermined path, the passivated surface defining a positive electrode active surface;

b) coating the positive electrode active surface with an olefinic substance to form on the surface micro-droplets of olefinic substance;

c) forming on the olefin-coated positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and d) bringing a substrate into contact with the dots of colored, coagulated colloid to cause transfer of the colored, coagulated colloid from the positive electrode active surface onto the substrate and thereby imprint the substrate with the image.

Step (c) of the above method is carried out by:

i) providing a series of negative electrolytically inert electrodes each having a surface, the negative electrodes being electrically insulated from one another and arranged in rectilinear alignment so that the surfaces thereof define a plurality of corresponding negative electrode active surfaces disposed in a plane spaced from the positive electrode active surface by a constant predetermined gap;

ii) filling the electrode gap with the aforesaid electrocoagulation printing ink;

iii) applying to selected ones of the negative electrodes a trigger signal of a voltage sufficient to energize same and cause point-by-point selective coagulation and adherence of the colloid onto the olefin-coated positive electrode active surface opposite the electrode active surfaces of the energized electrodes while the positive electrode active surface is moving, thereby forming the dots of colored, coagulated colloid, the trigger signal comprising at least two consecutive pulses having the aforesaid voltage and a predetermined pulse duration with a time interval therebetween at least as long as the pulse duration, to increase the amount of colored, coagulated colloid deposited onto the olefin-coated positive electrode active surface and forming each dot of colored, coagulated colloid, without causing undesirable gas generation at the negative electrodes, thereby increasing the optical density of each dot and of the resulting image; and iv) removing any remaining non-coagulated colloid from the positive electrode active surface.

If a polychromic image is desired, steps (b), (c) and (d) are repeated several times to define a corresponding number of printing stages arranged at predetermined locations along the aforesaid path and each using a coloring agent of different color, and to thereby produce several differently colored images of coagulated colloid which are transferred at respective transfer positions onto the substrate in superimposed relation to provide a polychromic image.

According to another aspect of the invention, there is provided a multicolor electrocoagulation printing method comprising the steps of:

a) providing a positive electrolytically inert electrode having a continuous passivated surface moving at substantially constant speed along a predetermined path, the passivated surface defining a positive electrode active surface;

b) coating the positive electrode active surface with an olefinic substance to form on the surface micro-droplets of olefinic substance;

c) forming on the olefin-coated positive electrode active surface a plurality of colored pixels representative of a desired polychromic image, each pixel comprising juxtaposed dots of differently colored, coagulated colloid; and d) bringing a substrate into contact with the colored pixels to cause transfer of the colored pixels from the positive electrode active surface onto the substrate and thereby imprint the substrate with the polychromic image.

Step (c) of the above method is carried out by:

i) providing a series of negative electrolytically inert electrodes each having a cylindrical configuration with a predetermined cross-sectional dimension and an end surface, the negative electrodes being electrically insulated from one another and arranged in rectilinear alignment so that the end surfaces thereof define a plurality of corresponding negative electrode active surfaces disposed in a plane spaced from the positive electrode active surface by a constant predetermined gap; ii) filling the electrode gap with an eletrocoagulation printing ink comprising a liquid colloidal dispersion containing an electrolytically coagulated colloid, a dispersing medium, a soluble electrolyte and a coloring agent;

iii) applying to selected ones of the negative electrodes a trigger signal of a voltage sufficient to energize same and cause point-by-point selective coagulation and adherence of the colloid onto the olefin-coated positive electrode active surface opposite the electrode active surfaces of the energized electrodes while the positive electrode active surface is moving, thereby forming dots of colored, coagulated colloid, the trigger signal comprising at least two consecutive pulses having the aforesaid voltage and a predetermined pulse duration with a time interval therebetween at least as long as the pulse duration, to increase the amount of colored, coagulated colloid deposited onto the olefin-coated positive electrode active surface and forming each dot of colored, coagulated colloid, without causing undesirable gas generation at the negative electrodes, thereby increasing the optical density of each dot and of the resulting image;

iv) removing any remaining non-coagulated colloid from the positive electrode active surface; and v) repeating steps (i) through (iv) several times to define a corresponding number of printing stages arranged at predetermined locations along the aforesaid path and each using a coloring agent of different color to produce dots of differently colored, coagulated colloid, the distance between the negative electrodes of each printing stage being at least three times the cross-sectional dimension of each negative electrode to permit juxtaposition of the dots of differently colored, coagulated colloid, thereby forming the colored pixels.

Applicant has found quite unexpectedly that by applying to the negative electrodes a trigger voltage signal comprising at least two consecutive pulses having a predetermined pulse duration with a time interval therebetween at least as long as the pulse duration, the amount of colored, coagulated colloid deposited onto the olefin-coated positive electrode surface and forming each dot of colored, coagulated colloid can be increased without causing undesirable gas generation at the negative electrodes, thereby increasing the optical density of each dot and of the resulting image. A time interval between consecutive pulses at least as long as the pulse duration has been found essential to prevent undesirable gas generation from occurring during the consecutive pulse. For example, in the case of an electrocoagulation printing ink having an electrolytic conductivity of 100 mS at 30° C., to print with maximum optical density, one may apply to the negative electrodes a trigger voltage signal comprising two consecutive pulses each having a pulse duration of 4 microseconds with a time interval of 4, 8 or 12 microseconds therebetween, without causing an undesirable gas generation at the negative electrodes, as opposed to a single pulse having a duration of 8 microseconds which would cause an undesirable gas generation at the electrodes.

The method of the invention also enables one to reduce the content of coloring agent by 50% in the electrocoagulation printing ink. By reducing the content of coloring agent in the ink, one can substantially reduce undesirable background image consisting of a thin film of colored, non-coagulated colloid which cannot be removed from the positive electrode active surface by squeegees and is thus transferred onto the substrate.

By reducing the content of coloring agent in the ink, one also reduces the viscosity of the ink. An ink of reduced viscosity is more appropriate for prolonged printing. Such an ink also has less tendency to cause formation of a gelatinous material which deposits onto the surface of the negative electrodes, as described in Applicant's U.S. patent application Ser. No. 09/774,059 now U.S. Pat. No. 6,458,261 now U.S. Pat. No. 6,458,261.

The dots of colored, coagulated colloid produced in accordance with the present invention have increased resistance to squeegee abrasion.

Use can be made of an electrocoagulation printing ink having an electrolytic conductivity of 50 to 150 mS at 30° C. In such a case, the trigger voltage signal applied to the negative electrodes comprises at least two consecutive pulses having a pulse duration of 15 nanoseconds to 8 microseconds. As previously indicated, where the electrocoagulation printing ink used has an electrolytic conductivity of 100 mS at 30° C., the trigger voltage signal applied to the negative electrodes comprises at least two consecutive pulses having a pulse duration of up to about 4 microseconds. Such a maximum pulse duration can comprise 255 increments of 15.68 nanoseconds, 63 increments of 63.49 nanoseconds or 31 increments of 129 nanoseconds. This enables one to cover all optical densities during electrocoagulation printing by stopping the pulses at any time increment depending upon the desired optical density.

According to a preferred embodiment, the negative electrodes are regrouped by electronic circuitry in four segments of 1792 cathodes, and the four segments of 1792 cathodes are energized in sequential order with a trigger voltage signal comprising two consecutive pulses having a pulse duration of up to 4 microseconds and a time interval therebetween of at least 4 microseconds. The regrouping of negative electrodes in printing segments allows to speed up the printing process.

Preferably, the electrocoagulation printing ink is maintained at a temperature of about 40° C.

Where an image resolution having 400 lines per inch or more is desired, the negative electrodes are arranged so as to be spaced from one another by a distance smaller than the electrode gap. Between steps (c) (ii) and (iii), a pulsed bias voltage ranging from −1.5 to −40 volts and having a pulse duration of 15 nanoseconds to 6 microseconds is applied to the negative electrodes, the bias voltage applied being inversely and non-linearly proportional to the pulse duration. As explained in the aforementioned U.S. application Ser. No. 09/774,059, now U.S. Pat. No. 6,458,261 now U.S. Pat. No. 6,458,261 the teaching of which is incorporated herein by reference, this prevents undesirable formation of a gelatinous deposit on the surfaces of the negative electrodes, and of a low-density blur on the electrocoagulation printed image, while enabling the negative electrodes to be positioned close to one another with a spacing therebetween smaller than the electrode gap, without undergoing edge corrosion. If the pulsed bias voltage is less than −1.5 volts at a pulse duration of 6 microseconds, the passive oxide film of each negative electrode upon being energized dissolves into the ink, resulting in a release of metal ions and edge corrosion of the negative electrodes. On the other hand, if the pulsed bias voltage is greater than −40 volts at a pulse duration of 15 nanoseconds, such a voltage is sufficient to cause formation of the gelatinous deposit and low-density blur. If the pulse duration is shorter than 15 nanoseconds, the negative electrodes undergo edge corrosion and, if it is longer than 6 microseconds, there is formation of the gelatinous deposit and of the low-density blur. The pulse duration must therefore be insufficient for the bias voltage to cause formation of the gelatinous deposit and the low-density blur, yet sufficient for the bias voltage to protect the negative electrodes against edge corrosion. Thus, by operating with a pulsed bias voltage ranging from −1.5 to −40 volts and having a pulse duration of 15 nanoseconds to 6 microseconds, preferably about −2 volts at a pulse duration of 4 microseconds, and by positioning the negative electrodes sufficiently close to one another with a spacing therebetween smaller than the electrode gap, an image resolution as high as 400 lines per inch, or more, can be obtained without adverse effect. Preferably, a pulsed bias voltage of about −2 volts with a pulse duration of about 4 microseconds is applied to the negative electrodes. The aforesaid trigger voltage signal is then applied in step (c) (iii) to selected ones of the negative electrodes to energize same and cause point-by-point selective coagulation and adherence of the colloid onto the olefin-coated positive electrode surface opposite the surfaces of the energized electrodes, and to increase the amount of colored, coagulated colloid deposited on the olefin-coated positive electrode active surface and forming each dot of colored, coagulated colloid.

If an image resolution of 200 lines per inch is considered sufficient, it is no longer necessary to apply a pulsed bias voltage to the negative electrodes. However, as explained in Applicant's U.S. Pat. No. 4,895,629, the negative electrodes must be spaced from one another by a distance which is equal to or greater than the electrode gap in order to prevent the negative electrodes from undergoing edge corrosion.

The positive electrode which is used for electrocoagulation printing must be made of an electrolytically inert metal capable of releasing trivalent ions so that upon electrical energization of the negative electrodes, dissolution of the passive oxide film on such an electrode generates trivalent ions which then initiate coagulation of the colloid. Examples of suitable electrolytically inert metals include stainless steel, aluminium and tin.

As explained in Applicant's U.S. Pat. No. 5,750,593 of Mar. 12, 1998, the teaching of which is incorporated herein by reference, a breakdown of passive oxide films occurs in the presence of electrolyte anions, such as $Cl^-$, $Br^-$ and $I^-$, there being a gradual oxygen displacement from the passive film by the halide anions and a displacement of adsorbed oxygen from the metal surface by the halide anions. The velocity of passive film breakdown, once started, increases explosively in the presence of an applied electric field. There is thus formation of a soluble metal halide at the metal surface. In other words, a local dissolution of the passive oxide film occurs at the breakdown sites, which releases metal ions into the electrolyte solution. Where a positive electrode made of stainless steel or aluminium is utilized in Applicant's electrocoagulation printing method, dissolution of the passive oxide film on such an electrode generates $Fe^{3+}$ or $Al^{3+}$ ions. These trivalent ions then initiate coagulation of the colloid.

The positive electrode can be in the form of a moving endless belt as described in Applicant's U.S. Pat. No. 4,661,222, or in the form of a revolving cylinder as described in Applicant's U.S. Pat. Nos. 4,895,629 and 5,538,601, the teachings of which are incorporated herein by reference. In the latter case, the printing stages or units are arranged around the positive cylindrical electrode. Preferably, the positive electrode active surface and the ink are maintained at a temperature of about 35–60° C., preferably 40° C., to increase the viscosity of the coagulated colloid in step (c) so that the dots of colored, coagulated colloid remain coherent during their transfer in step (d), thereby enhancing transfer of the colored, coagulated colloid onto the substrate. For example, the positive electrode active surface can be heated at the desired temperature and the ink applied on the heated electrode surface to cause a transfer of heat therefrom to the ink.

Coating of the positive electrode with an olefinic substance prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes.

Examples of suitable olefinic substances which may be used to coat the surface of the positive electrode in step (b) include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. Oleic acid is particularly preferred. The micro-droplets formed on the surface of the positive electrode active surface generally have a size ranging from about 1 to about 5$\mu$.

The olefin-coated positive active surface is preferably polished to increase the adherence of the micro-droplets onto the positive electrode active surface, prior to step (c). For example, use can be made of a rotating brush provided with a plurality of radially extending bristles made of horsehair and having extremities contacting the surface of the positive electrode. The friction caused by the bristles contacting the surface upon rotation of the brush has been found to increase the adherence of the micro-droplets onto the positive electrode active surface.

Where the positive cylindrical electrode extends vertically, step (c)(ii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a weight average molecular weight between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a weight average molecular weight of about 250,000 and sold by Cyanamid Inc. under the trademark ACCOSTRENGTH 85. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. Potassium chloride is particularly preferred. The coloring agent can be a dye or a pigment. Examples of suitable dyes which may be used to color the colloid are the water soluble dyes available from Hoechst such as Duasyn Acid Black for coloring in black and Duasyn Acid Blue for coloring in cyan, or those available from Riedel-Dehaen such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from Cabot Corp. such as Carbon Black Monarch® 120 for coloring in black, or those available from Hoechst such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the anionic dispersing agent sold by Boehme Filatex Canada Inc. under the trademark CLOSPERSE 25000.

Preferably, the negative electrodes each have a cylindrical configuration with a circular cross-section and a diameter ranging from about 10 $\mu$m to about 50 $\mu$m. Electrodes having a diameter of about 15 $\mu$m are preferred. The gap which is defined between the positive and negative electrodes can range from about 35 $\mu$m to about 100 $\mu$m, the smaller the electrode gap the sharper are the dots of coagulated colloid produced. Where the electrode gap is of the order of 50 $\mu$m, the negative electrodes preferably have a diameter of about 15 $\mu$m and are spaced from one another by a distance of about 48 $\mu$m. Examples of suitable electrolytically inert metals from which the negative electrodes can be made include chromium, nickel, stainless steel and titanium; stainless steel is particularly preferred. The insulation material which is used for electrically insulating the negative electrodes from one another is preferably selected from the group consisting of cured methyl methacrylate, tetrafluoroethylene, glass, ceramic, epoxy resin, polyurethane resin and silicon resin. Cured methyl methacrylate is preferred.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

After step (d), the positive electrode active surface is generally cleaned to remove therefrom any remaining coagulated colloid. According to a preferred embodiment, the positive electrode is rotatable in a predetermined direction and any remaining coagulated colloid is removed from the positive electrode active surface by providing an elongated rotatable brush extending parallel to the longitudinal axis of the positive electrode, the brush being provided with a plurality of radially extending bristles made of horsehair and having extremities contacting the positive electrode active surface, rotating the brush in a direction opposite to the direction of rotation of the positive electrode so as to cause the bristles to frictionally engage the positive electrode active surface, and directing jets of cleaning liquid under pressure against the positive electrode active surface, from either side of the brush. In such an embodiment, the positive electrode active surface and the ink are preferably maintained at a temperature of about 35–60° C. by heating the cleaning liquid to thereby heat the positive electrode active surface upon contacting same and applying the ink on the heated electrode surface to cause a transfer of heat therefrom to the ink.

BRIEF DESCRIPTION OF THE DRAWINGS

Further features and advantages of the invention will become more readily apparent from the following description of a preferred embodiment, reference being made to the accompanying drawings in which.

DESCRIPTION OF PREFERRED EMBODIMENT

Figure 1:
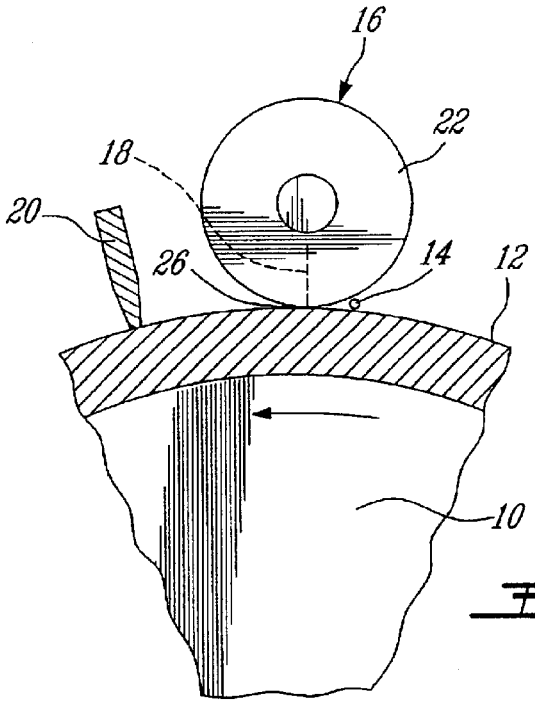
FIG. 1 is a schematic partial view of an electrocoagulation printing unit showing a printing head arranged in close proximity to a cylindrical positive electrode for producing thereon dots of colored, coagulated colloid in accordance with a preferred embodiment of the invention.

Referring first to FIG. 1, use is made of a positive electrode 10 in the form of a rotating cylinder, the electrode 10 having a passivated surface 12 defining a positive electrode active surface. A positive electrode coating device (not shown) is used for coating the positive electrode active surface 12 with an olefinic substance to form on the surface 12 micro-droplets of olefinic substance. A device 14 is provided for discharging an electrocoagulation printing ink onto the olefin-coated surface 12. A printing head 16 having a plurality of negative electrodes 18 is used for electrocoagulating the colloid present in the ink to form on the olefin-coated surface 12 dots of colored, coagulated colloid. A soft rubber squeegee 20 is provided for removing any remaining non-coagulated colloid from the surface 12. The electrocoagulation printing ink consists of a colloidal dispersion containing an electrolytically coagulable colloid, a dispersing medium, a soluble electrolyte and a coloring agent.

Figure 2:
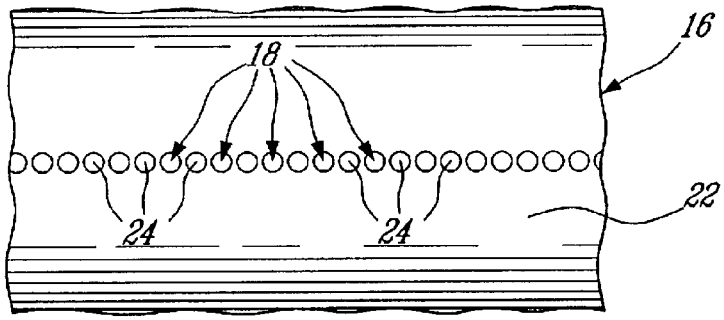
FIG. 2 is a fragmentary longitudinal view of the printing head shown in FIG. 1.

As shown in FIG. 2, the printing head 16 comprises a cylindrical electrode carrier 22 with the negative electrodes 18 being electrically insulated from one another and arranged in rectilinear alignment along the length of the electrode carrier 22 to define a plurality of corresponding negative electrode active surfaces 24. The printing head 16 is positioned relative to the positive electrode 10 such that the surfaces 24 of the negative electrodes 18 are disposed in a plane which is spaced from the positive electrode surface 12 by a constant predetermined gap 26. The electrodes 18 are also spaced from one another by a distance smaller than the electrode gap 26 to increase image resolution. The device 14 is positioned adjacent the electrode gap 26 to fill same with the electrocoagulation printing ink.

Figure 3:
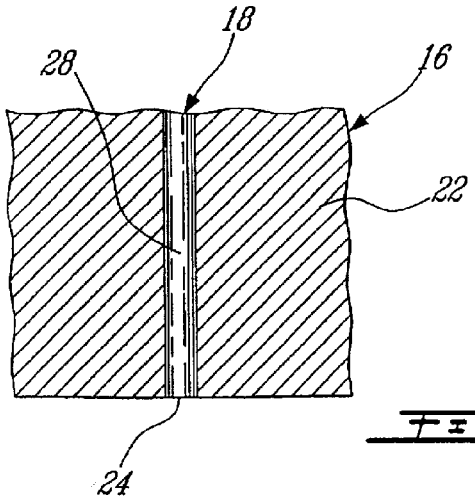
FIG. 3 is a fragmentary sectional view of the printing head illustrated in FIG. 2, showing one of the negative electrodes.

As shown in FIG. 3, the negative electrodes 18 each have a cylindrical body 28 made of an electrolytically inert metal. The end surface of the electrode body 28 defines the aforementioned negative electrode active surface 24.

Figure 4:
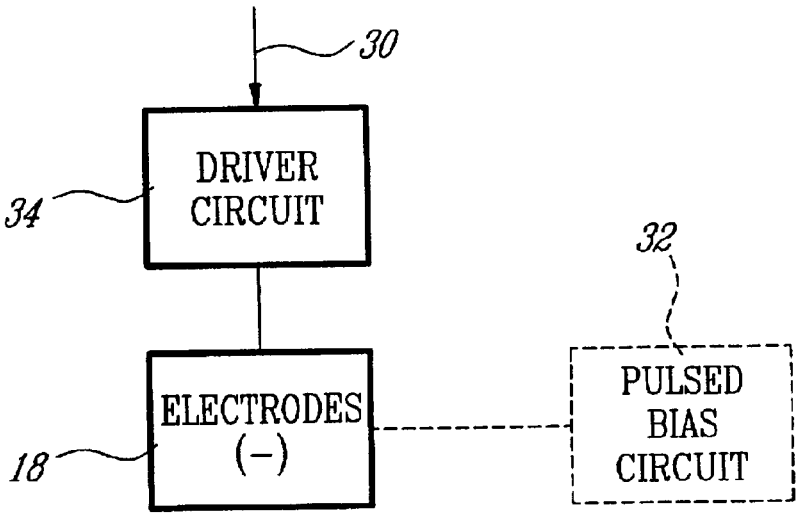
FIG. 4 is a schematic diagram showing how the negative electrodes of the printing head are energized in response to an input signal of information.

FIG. 4 is schematic diagram illustrating how the negative electrodes 18 of the printing head 16 are energized in response to an input signal of information 30 to form dots of colored, coagulated colloid. An optional pulsed bias circuit 32 is provided for applying to the negative electrodes 18 a pulsed bias voltage ranging from −1.5 to −40 volts and having a pulse duration of 15 nanoseconds to 6 microseconds. The pulsed bias voltage applied by the circuit 32 to the negative electrodes 18 is inversely and nonlinearly proportional to the pulse duration. If a pulsed bias circuit is not used, the negative electrodes 18 must be spaced from one another by a distance which is equal to or greater than the electrode gap 26 in order to prevent the negative electrodes 18 from undergoing edge corrosion. An image resolution of 200 lines per inch is obtained in such a case. A driver circuit 34 is also used for addressing selected ones of the electrodes 18 so as to apply a trigger voltage signal to the selected electrodes and energize same. Such an electrical energizing causes point-by-point selective coagulation and adherence of the colloid onto the olefin-coated surface 12 of the positive electrode 10 opposite the electrode active surfaces 24 of the energized electrodes 18 while the electrode 10 is rotating, thereby forming on the surface 12 a series of corresponding dots of colored, coagulated colloid.

Figure 5:
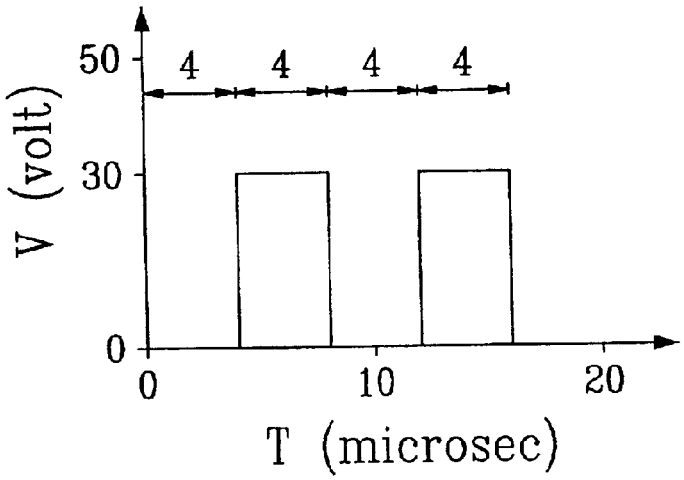
FIG. 5 is a graph of voltage over time showing the trigger signal applied to the negative electrodes.

FIG. 5 illustrates the trigger signal applied by the driver circuit 34 to the selected electrodes 18, when the electrocoagulation printing ink used has an electrolytic conductivity of 100 mS at 30° C. As shown, the trigger signal comprises two consecutive pulses having a voltage of about +30 volts and a pulse duration of 4 microseconds with a time interval therebetween of 4 microseconds. Such a trigger signal allows one to increase the amount of colored, coagulated colloid deposited onto the olefin-coated positive electrode active surface 12 and forming each dot of colored, coagulated colloid, without causing undesirable gas generation at the negative electrodes 18, thereby increasing the optical density of each dot.

I claim:

1. In an electrocoagulation printing method comprising the steps of:

a) providing a positive electrolytically inert electrode having a continuous passivated surface moving at substantially constant speed along a predetermined path, said passivated surface defining a positive electrode active surface;

b) coating said positive electrode active surface with an olefinic substance to form on the surface micro-droplets of olefinic substance;

c) forming on the olefin-coated positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and d) bringing a substrate into contact with the dots of colored, coagulated colloid to cause transfer of the colored, coagulated colloid from the positive electrode active surface onto said substrate and thereby imprint said substrate with said image;

the improvement wherein step (c) is carried out by:

i) providing a series of negative electrolytically inert electrodes each having a surface, said negative electrodes being electrically insulated from one another and arranged in rectilinear alignment so that the surfaces thereof define a plurality of corresponding negative electrode active surfaces disposed in a plane spaced from said positive electrode active surface by a constant predetermined gap;

ii) filling the electrode gap with said electrocoagulation printing ink;

iii) applying to selected ones of said negative electrodes a trigger signal of a voltage sufficient to energize same and cause point-by-point selective coagulation and adherence of the colloid onto the olefin-coated positive electrode active surface opposite the electrode active surfaces of said energized electrodes while said positive electrode active surface is moving, thereby forming said dots of colored, coagulated colloid, said trigger signal comprising at least two consecutive pulses having said voltage and a predetermined pulse duration with a time interval therebetween at least as long as said predetermined pulse duration, to increase the amount of colored, coagulated colloid deposited onto the olefin-coated positive electrode active surface and forming each dot of colored, coagulated colloid, without causing undesirable gas generation at the negative electrodes, thereby increasing optical density of each said dot; and iv) removing any remaining non-coagulated colloid from said positive electrode active surface.

2. A method as claimed in claim 1, wherein said electrocoagulation printing ink has an electrolytic conductivity of 50 to 150 mS at 30° C., and wherein said trigger signal comprises at least two consecutive pulses having a pulse duration of 15 nanoseconds to 8 microseconds.

3. A method as claimed in claim 2, wherein said electrocoagulation printing ink has an electrolytic conductivity of 100 mS at 30° C. and wherein said trigger signal comprises at least two consecutive pulses having a pulse duration of up to about 4 microseconds.

4. A method as claimed in claim 3, wherein the time interval between consecutive pulses is 4, 8 or 12 microseconds.

5. A method as claimed in claim 3, wherein said pulse duration comprises up to 255 increments of 15.68 nanoseconds.

6. A method as claimed in claim 3, wherein said pulse duration comprises up to 63 increments of 63.49 nanoseconds.

7. A method as claimed in claim 3, wherein said pulse duration comprises up to 31 increments of 129 nanoseconds.

8. A method as claimed in claim 3, wherein said negative electrodes are regrouped by electronic circuitry in four segments of 1792 cathodes.

9. A method as claimed in claim 8, wherein said four segments of 1792 cathodes are energized in sequential order and wherein said trigger signal comprises two consecutives pulses having a pulse duration of up to 4 microseconds with a time interval therebetween of at least 4 microseconds.

10. A method as claimed in claim 1, wherein said negative electrodes are spaced from one another by a distance equal to or greater than said gap.

11. A method as claimed in claim 1, wherein said negative electrodes are spaced from one another by a distance small than said gap, and wherein a pulsed bias voltage ranging from −1.5 to −40 volts and having a pulse duration of 15 nanoseconds to 6 microseconds is applied to said negative electrodes, the bias voltage applied being inversely and non-linearly proportional to the pulse duration.

12. A method as claimed in claim 11, wherein a pulsed bias voltage of about −2 volts with a pulse duration of about 4 microseconds is applied to the negative electrodes.

13. A method as claimed in claim 1, wherein the negative electrodes are formed of an electrolytically inert metal selected from the group consisting of chromium, nickel, stainless steel and titanium.

14. A method as claimed in claim 13, wherein the electrolytically inert metal comprises stainless steel.

15. A method as claimed in claim 1, wherein the negative electrodes are electrically insulated from one another by an insulation material selected from the group consisting of cured methyl methacrylate, tetrafluoroethylene, glass, ceramic, epoxy resin, polyurethane resin and silicon resin.

16. A method as claimed in claim 15, wherein the insulation material is cured methyl methacrylate.

17. A method as claimed in of claim 1, wherein steps (b), (c) and (d) are repeated several times to define a corresponding number of printing stages arranged at predetermined locations along said path and each using a coloring agent of different color, to thereby produce differently colored images of coagulated colloid which are transferred at respective transfer positions onto said substrate in superimposed relation to provide a polychromic image.

18. A method as claimed in claim 17, wherein the positive electrode is a cylindrical electrode having a central longitudinal axis and rotating at substantially constant speed about said longitudinal axis, and wherein said printing stages are arranged around said cylindrical electrode.

19. A method as claimed in claim 18, wherein the positive electrode is formed of stainless steel.

20. In a multicolor electrocoagulation printing method comprising the steps of:

a) providing a positive electrolytically inert electrode having a continuous passivated surface moving at substantially constant speed along a predetermined path, said passivated surface defining a positive electrode active surface;

b) coating said positive electrode active surface with an olefinic substance to form on the surface micro-droplets of olefinic substance;

c) forming on the olefin-coated positive electrode active surface a plurality of colored pixels representative of a desired polychromic image, each pixel comprising juxtaposed dots of differently colored, coagulated colloid; and d) bringing a substrate into contact with the colored pixels to cause transfer of said colored pixels from the positive electrode active surface onto said substrate and thereby imprint said substrate with said polychromic image;

the improvement wherein step (c) is carried out by:

i) providing a series of negative electrolytically inert electrodes each having a cylindrical configuration with a predetermined cross-sectional dimension and an end surface, the negative electrodes being electrically insulated from one another and arranged in rectilinear alignment so that the end surfaces thereof define a plurality of corresponding negative electrode active surfaces disposed in a plane spaced from the positive electrode active surface by a constant predetermined gap;

ii) filling the electrode gap with an electrocoagulation printing ink comprising a liquid colloidal dispersion containing an electrolytically coagulated colloid, a dispersing medium, a soluble electrolyte and a coloring agent;

iii) applying to selected ones of said negative electrodes a trigger signal of a voltage sufficient to energize same and cause point-by-point selective coagulation and adherence of the colloid onto the olefin-coated positive electrode active surface opposite the electrode active surfaces of said energized electrodes while said positive electrode active surface is moving, thereby forming dots of colored, coagulated colloid, said trigger signal comprising at least two consecutive pulses having said voltage and a predetermined pulse duration with a time interval therebetween at least as long as said predetermined pulse duration, to increase the amount of colored, coagulated colloid deposited onto the olefin-coated positive electrode active surface and forming each dot of colored, coagulated colloid, without causing undesirable gas generation at the negative electrodes, thereby increasing optical density of each said dot;

iv) removing any remaining non-coagulated colloid from said positive electrode active surface; and v) repeating steps (i) through (iv) several times to define a corresponding number of printing stages arranged at predetermined locations along said path and each using a coloring agent of different color to produce dots of differently colored, coagulated colloid, the distance between the negative electrodes of each printing stage being at least three times the cross-sectional dimension of each negative electrode to permit juxtaposition of said dots of differently colored, coagulated colloid, thereby forming said colored pixels.

21. A method as claimed in claim 20, wherein said electrocoagulation printing ink has an electrolytic conductivity of 50 to 150 mS at 30° C., and wherein said trigger signal comprises at least two consecutive pulses having a pulse duration of 15 nanoseconds to 8 microseconds.

22. A method as claimed in claim 21, wherein said electrocoagulation printing ink has an electrolytic conductivity of 100 mS at 30° C. and wherein said trigger signal comprises at least two consecutive pulses having a pulse duration of up to about 4 microseconds.

23. A method as claimed in claim 22, wherein the time interval between consecutive pulses is 4, 8 or 12 microseconds.

24. A method as claimed in claim 22, wherein said pulse duration comprises up to 255 increments of 15.68 nanoseconds.

25. A method as claimed in claim 22, wherein said pulse duration comprises up to 63 increments of 63.49 nanoseconds.

26. A method as claimed in claim 22, wherein said pulse duration comprises up to 31 increments of 129 nanoseconds.

27. A method as claimed in claim 22, wherein said negative electrodes are regrouped by electronic circuitry in four segments of 1792 cathodes.

28. A method as claimed in claim 27, wherein said four segments of 1792 cathodes are energized in sequential order and wherein said trigger signal comprises two consecutives pulses having a pulse duration of up to 4 microseconds with a time interval therebetween of at least 4 microseconds.

29. A method as claimed in claim 20, wherein said negative electrodes each have a circular cross-section with a diameter ranging from about 10 to about 50 $\mu$m.

30. A method as claimed in claim 29, wherein the electrode gap ranges from about 35 to about 100 $\mu$m.

31. A method as claimed in claim 30, wherein the electrode gap is about 50 $\mu$m.

32. A method as claimed in claim 31, wherein said negative electrodes each have a diameter of about 15 $\mu$m and are spaced from one another by a distance of about 48 $\mu$m.

33. A method as claimed in claim 20, wherein said negative electrodes are spaced from one another by a distance greater than said gap.

34. A method as claimed in claim 20, wherein said negative electrodes are spaced from one another by a distance smaller than said gap, and wherein a pulsed bias voltage ranging from −1.5 to −40 volts and having a pulse duration of 15 nanoseconds to 6 microseconds is applied to said negative electrodes, the bias voltage applied being inversely and non-linearly proportional to the pulse duration.

35. A method as claimed in claim 34, wherein a pulsed bias voltage of about −2 volts with a pulse duration of about 4 microseconds is applied to the negative electrodes.

36. A method as claimed in claim 20, wherein the negative electrodes are formed of an electrolytically inert metal selected from the group consisting of chromium, nickel, stainless steel and titanium.

37. A method as claimed in claim 36, wherein the electrolytically inert metal comprises stainless steel.

38. A method as claimed in claim 20, wherein the negative electrodes are electrically insulated from one another by an insulation material selected from the group consisting of cured methyl methacrylate, tetrafluoroethylene, glass, ceramic, epoxy resin, polyurethane resin and silicon resin.

39. A method as claimed in claim 38, wherein the insulation material is cured methyl methacrylate.

40. A method as claimed in claim 20, wherein the positive electrode is a cylindrical electrode having a central longitudinal axis and rotating at substantially constant speed about said longitudinal axis, and wherein said printing stages are arranged around said cylindrical electrode.

41. A method as claimed in claim 40, wherein the positive electrode is formed of stainless steel.

* * * * *